US010559896B2

(12) United States Patent
Sato et al.

(10) Patent No.: US 10,559,896 B2
(45) Date of Patent: Feb. 11, 2020

(54) TERMINAL-EQUIPPED ELECTRIC WIRE AND METHOD FOR MANUFACTURING TERMINAL-EQUIPPED ELECTRIC WIRE

(71) Applicant: Yazaki Corporation, Tokyo (JP)

(72) Inventors: Tomoya Sato, Shizuoka (JP); Naoki Ito, Shizuoka (JP); Yasunori Nabeta, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 16/200,957

(22) Filed: Nov. 27, 2018

(65) Prior Publication Data

US 2019/0165491 A1 May 30, 2019

(30) Foreign Application Priority Data

Nov. 28, 2017 (JP) ..... 2017-227440

(51) Int. Cl.
*H01R 4/18* (2006.01)
*H01R 43/048* (2006.01)
*H01R 11/12* (2006.01)

(52) U.S. Cl.
CPC ..... *H01R 4/185* (2013.01); *H01R 43/048* (2013.01); *H01R 4/187* (2013.01); *H01R 11/12* (2013.01)

(58) Field of Classification Search
CPC ..... H01R 4/185; H01R 4/02; H01R 43/02; H01R 43/048; H01R 43/058
See application file for complete search history.

(56) References Cited

U.S. PATENT DOCUMENTS

| | | | | |
|---|---|---|---|---|
| 9,419,490 | B2 * | 8/2016 | Kajita | B23K 20/10 |
| 10,276,283 | B2 * | 4/2019 | Nabeta | H01B 5/08 |
| 10,283,924 | B2 * | 5/2019 | Bauer | H01R 4/187 |
| 2011/0094797 | A1 * | 4/2011 | Otsuka | H01R 43/0207 174/84 C |
| 2013/0025935 | A1 * | 1/2013 | Takayama | H01R 4/184 174/75 R |

FOREIGN PATENT DOCUMENTS

| | | |
|---|---|---|
| JP | 2009-231079 A | 10/2009 |
| JP | 2011-82127 A | 4/2011 |
| JP | 2015-159014 A | 9/2015 |

* cited by examiner

*Primary Examiner* — Xuong M Chung Trans
(74) *Attorney, Agent, or Firm* — Sughrue Mion, PLLC

(57) ABSTRACT

A terminal-equipped electric wire has an electric wire including a bonded portion formed over a predetermined length at a part of a conductor exposed due to absence of a sheath over a predetermined length at a part of the electric wire in a longitudinal direction and in which strands of the conductor are bonded to each other; and a terminal including a wire barrel portion, the wire barrel portion covering at least a part of the bonded portion. The wire barrel portion includes a load release portion configured to reduce stress applied to the conductor.

11 Claims, 9 Drawing Sheets

TERMINAL-EQUIPPED ELECTRIC WIRE AND METHOD FOR MANUFACTURING TERMINAL-EQUIPPED ELECTRIC WIRE

CROSS REFERENCE TO RELATED APPLICATION

This application is based upon and claims the benefit of priority from the prior Japanese Patent Application No. 2017-227440 (filing date: Nov. 28, 2017), the entire contents of which are incorporated herein by reference.

BACKGROUND

Technical Field

The invention relates to a terminal-equipped electric wire, a method for manufacturing a terminal-equipped electric wire, and the like, and more particularly to a terminal-equipped electric wire in which a wire barrel portion of a terminal is mounted to a conductor where a plurality of strands of the conductor is bonded to each other.

Related Art

Conventionally, a terminal-equipped electric wire 301 as illustrated in FIGS. 16A to 17 is known (see JP 2009-231079 A).

The terminal-equipped electric wire 301 is formed as follows. First, an exposed conductor 305 at a distal end portion of an electric wire 307 (see FIG. 16A) in which a sheath 303 is removed to expose the conductor (core wire) 305 at one end is bonded by ultrasonic bonding (see FIG. 16B).

That is, the distal end portion of the conductor 305, including a plurality of strands 311, is bonded by ultrasonically bonding the respective strands 311, thereby forming a bonded portion 309.

As a terminal 315 is fixed to the bonded portion 309 by crimping a wire barrel portion 313 using a crimper 310 illustrated in FIGS. 18A and 18B, it is possible to obtain the terminal-equipped electric wire 301 (see FIGS. 16C and 17).

SUMMARY

Incidentally, the conventional terminal-equipped electric wire 301 has a problem that there is a risk that strand breakage (core wire breakage) may occur at an end (end on a side of the sheath 303) 317 of the bonded portion 309 (see FIG. 17).

That is, when the wire barrel portion 313 is crimped to the electric wire 307 forming the bonded portion 309 to crimp the terminal 315 or when the terminal 315 is crimped, the bonded portion 309 is compressed so that the conductor 305 is pulled at a rear end portion (a right end portion in FIG. 17) of the wire barrel portion 313, whereby the strand 311 is broken at an end of the bonded portion 309 (a boundary portion between the bonded portion 309 and a non-bonded portion) 317 as illustrated in FIG. 17.

Then, mechanical connection strength between the terminal 315 and the conductor 305 decreases, and an electrical resistance value between the terminal 315 and the conductor 305 increases (performance of a crimped portion deteriorates).

At the boundary portion 317, a value of residual stress is increased due to the influence of the bonding process so that the strand 311 is easily broken. Further, a sectional shape (shape of a cross section according to a plane orthogonal to the longitudinal direction) of the strand 311 sharply changes at the boundary portion 317 so that stress concentration is likely to occur. What is denoted by reference signs 311A and 311B in FIG. 17 is strands generated by breakage of core wires.

The invention has been made in view of the above problems, and an object of the invention is to provide a terminal-equipped electric wire and the like in which a bonded portion is formed by bonding a part of a conductor and a wire barrel portion of a terminal is fixed to the bonded portion and which is capable of suppressing occurrence of breakage of a strand of the conductor.

A terminal-equipped electric wire according to first aspect of the present invention has an electric wire including a bonded portion formed at a part of a conductor exposed due to absence of a sheath at a part of the electric wire in a longitudinal direction and in which strands of the conductor are bonded to each other, and a terminal including a wire barrel portion, the wire barrel portion covering at least a part of the bonded portion. The wire barrel portion is provided with a load release portion configured to reduce stress applied to the conductor.

The load release portion may be provided in at least one end portion of the wire barrel portion, and a diameter of the load release portion may gradually increase toward an end of the wire barrel portion.

A relationship of $0<A\leq(d+2t)-Hc$ may be satisfied when a diameter of the conductor at a portion covered with the sheath is d, a thickness of the terminal is t, a height of the wire barrel portion of the terminal is Hc, and a height of a step of the load release portion is A.

Furthermore, a relationship of $H-Hw<A$ may be satisfied when a height of the bonded portion before the fixing of the terminal is H and a height of the bonded portion at a portion of the wire barrel portion excluding the load release portion after the fixing of the terminal is Hw.

A terminal-equipped electric wire according to second aspect of the present invention has an electric wire including a bonded portion formed at a part of a conductor exposed due to absence of a sheath at a part of the electric wire in a longitudinal direction and in which strands of the conductor are bonded to each other; and a terminal including a wire barrel portion, the wire barrel portion covering at least a part of the bonded portion. An end portion of the wire barrel portion gradually increases in diameter toward an end of the wire barrel portion.

A terminal-equipped electric wire according to the first aspect or the second aspect of the present invention may include an end of the wire barrel portion positioned on a side of the sheath being positioned to be closer to the sheath than an end of the bonded portion positioned on the side of the sheath.

Furthermore, the longitudinal direction of the electric wire and a front-rear direction of the wire barrel portion may coincide with each other, and the bonded portion may be positioned at an inner side of the wire barrel portion in the front-rear direction.

Moreover, one terminal of the terminal may be fixed to a plurality of the electric wires.

A method for manufacturing a terminal-equipped electric wire according to third aspect of the present invention includes forming, in an electric wire, a bonded portion in which strands of a conductor are bonded to each other at a part of the conductor in a longitudinal direction exposed due to absence of a sheath at a part of the electric wire in the longitudinal direction. A terminal including a wire barrel portion is fixed to the electric wire such that the wire barrel portion covers at least a part of the bonded portion after forming the bonded portion. The wire barrel portion is provided with a load release portion configured to reduce stress applied to the conductor.

According to the aspects of the present invention, a terminal-equipped electric wire and the like capable of suppressing occurrence of breakage of a strand of the conductor is provided.

DETAILED DESCRIPTION

Figure 1:
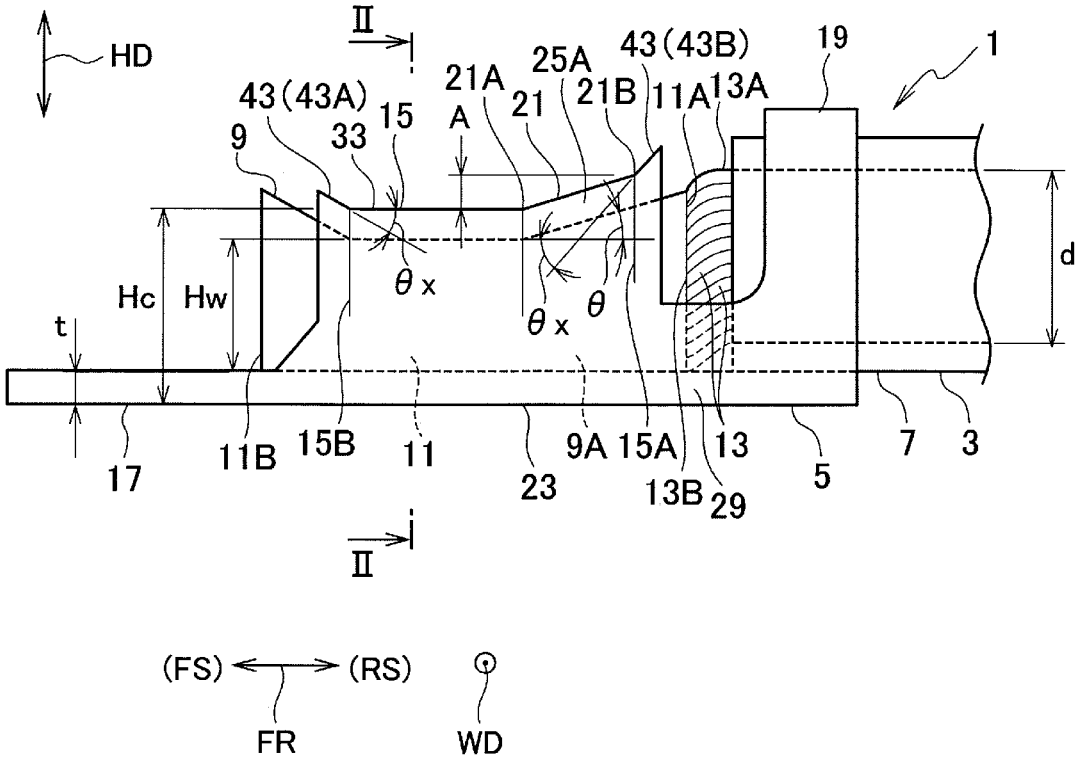
FIG. 1 is a view illustrating a schematic configuration of a terminal-equipped electric wire according to an embodiment of the invention.
Figure 5:
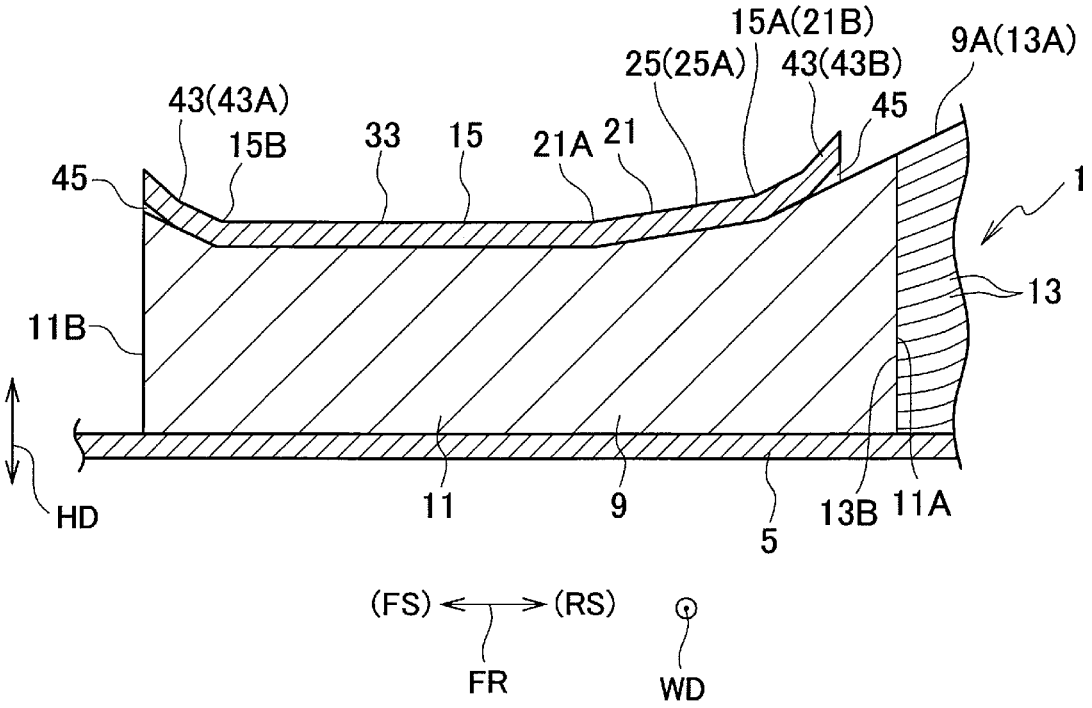
FIG. 5 is an enlarged cross-sectional view illustrating a schematic configuration of the terminal-equipped electric wire according to the embodiment of the invention.

As illustrated in FIGS. 1 and 5, a terminal-equipped electric wire 1 according to an embodiment of the invention includes an electric wire 3 and a terminal 5.

For convenience of description, it is assumed that a predetermined direction of the terminal-equipped electric wire 1 is the front-rear direction, a predetermined direction orthogonal to the front-rear direction is the height direction, and a direction orthogonal to the front-rear direction and the height direction is the width direction. Incidentally, the front-rear direction and the longitudinal direction of the electric wire 3 coincide with each other.

Since a sheath 7 is not present over a predetermined length at a part (for example, one end portion; a distal end portion) in the longitudinal direction (length direction) (for example, a part of the sheath 7 is removed), a conductor 9 is exposed in the electric wire 3.

In the electric wire 3, a bonded portion 11 is formed over a predetermined length in a part of the exposed conductor 9 (an exposed conductor 9A). The bonded portion 11 is formed by ultrasonic bonding (ultrasonic treatment) of a plurality of strands 13 for the conductor 9 with each other.

Figure 3:
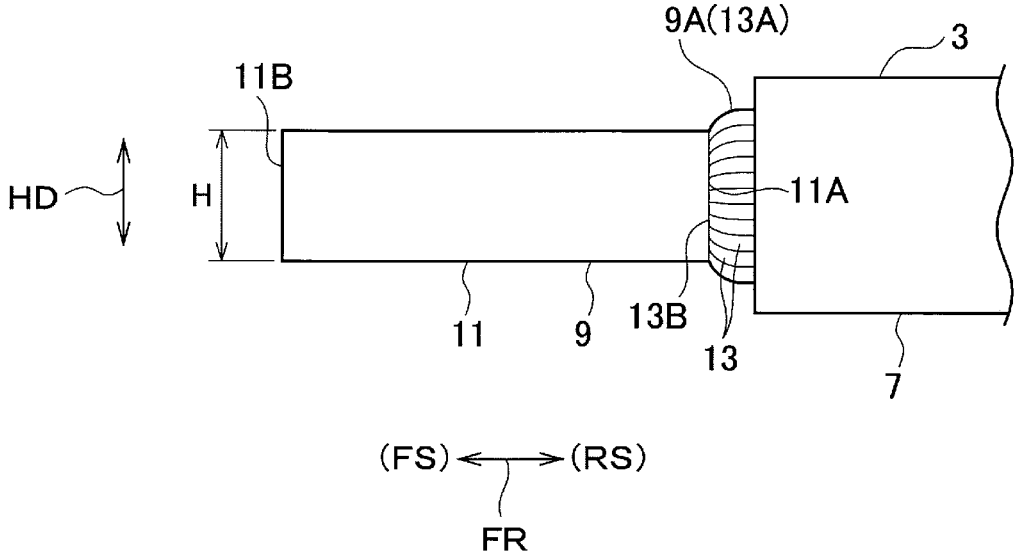
FIG. 3 is a view illustrating an electric wire in which a bonded portion is formed before fixing of a terminal.

More specifically, the electric wire 3 includes a conductor (core wire) 9 formed by gathering the plurality of strands 13, the sheath (insulator) 7 covering the conductor 9 as illustrated in FIG. 3 and the like.

The strand 13 of the conductor 9 is formed in an elongated cylindrical shape with metal such as copper, aluminum, and an aluminum alloy. The conductor 9 is configured in a form in which the plurality of strands 13 is twisted or a form in which the plurality of strands 13 collectively extends in a straight line.

Further, the electric wire 3 has flexibility. In addition, a cross section of a portion of the electric wire 3 where the sheath 7 is present (the cross section taken along a plane orthogonal to the longitudinal direction) is formed in a predetermined shape such as a circular shape.

A cross section of the conductor 9 at the portion of the electric wire 3 where the sheath 7 is present is formed in a substantially circular shape by bundling the plurality of strands 13 with almost no gap. A cross section of the sheath 7 at the portion of the electric wire 3 where the sheath 7 is present is formed in an annular shape having a predetermined width (thickness). The entire inner circumference of the sheath 7 is in contact with the entire outer circumference of the conductor 9.

In the bonded portion 11, the plurality of strands 13 for the conductor 9 is ultrasonically bonded to each other as described above such that the conductor 9 is formed into a single wire, for example.

Although the bonded portion 11 is formed by bonding the strands 13 to each other by ultrasonic bonding in the above description, the bonded portion 11 may be formed by bonding the strands 13 to each other by a bonding means other than the ultrasonic bonding. For example, the bonded portion 11 may be formed in the same manner as in the case of ultrasonic bonding by metallurgically bonding the strands 13 to each other at a temperature equal to or lower than a recrystallization temperature of the strand 13.

Further, the bonded portion 11 may be formed by treatment such as cold welding, friction stir welding, friction welding, electromagnetic welding, diffusion bonding, brazing, soldering, resistance welding, electron beam welding, laser welding, and light beam welding other than the ultrasonic treatment.

As illustrated in FIG. 3 and the like, the bonded portion 11 and the sheath 7 are apart from each other by a predetermined length, for example, in the longitudinal direction of the electric wire 3. As a result, a plurality of strands (a conductor in a non-bonded state) 13A, which is in contact with each other but is in a non-bonded state, is exposed between the bonded portion 11 and the sheath 7.

That is, the bonded portion 11 by the predetermined length, the conductor 13A in the non-bonded state, and the conductor 9 covered with the sheath 7 (the portion of the electric wire 3 where the sheath 7 is present) are arranged in this order from one end to the other end in the longitudinal direction (from the front side to the rear side) of the electric wire 3.

A sectional shape (sectional shape taken along the plane orthogonal to the longitudinal direction) of the bonded portion 11 before fixing of the terminal 5 is formed in a predetermined shape such as a circular shape and a rectangular shape.

A sectional shape (a cross section taken along the plane orthogonal to the longitudinal direction) of the conductor 13A in the non-bonded state before fixing of the terminal 5 gradually shifts from the sectional shape of the bonded portion 11 to a sectional shape of the conductor 9 covered with the sheath 7.

Figure 2:
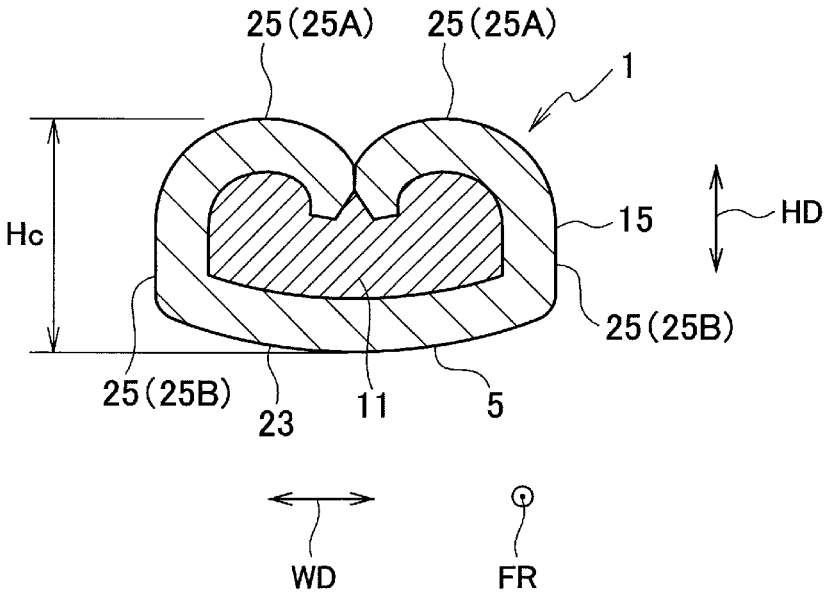
FIG. 2 is a view illustrating a cross section taken along line II-II in FIG. 1.

As illustrated in FIGS. 1, 2, and 5, the terminal (terminal fitting) 5 includes a wire barrel portion 15. Further, the wire barrel portion 15 of the terminal 5 covers (wraps) at least a part of the bonded portion 11.

The terminal 5 is formed, for example, by forming a flat metal material having a constant thickness into a predetermined shape, and then, appropriately bending the material formed in the predetermined shape. Therefore, a thickness of a wall in almost the entire portion of the terminal 5 (for example, the thickness denoted by a reference sign tin FIG. 1) is constant.

The terminal 5 is provided with not only the wire barrel portion 15 but also a terminal connection portion (mating terminal connection portion) 17 connected to a mating terminal and an insulation barrel portion 19. The mating terminal connection portion 17, the wire barrel portion 15, and the insulation barrel portion 19 are arranged in this order from the front side to the rear side.

Further, the wire barrel portion 15 of the terminal 5 is provided with a load release portion (stress relieving portion) 21. The load release portion 21 forms a part of the wire barrel portion 15 and is provided in at least one end portion (for example, a rear end portion) of the wire barrel portion 15 in the front-rear direction.

The load release portion 21 is provided to reduce the stress applied to the conductor 9 (strand 13). For example, when the terminal 5 is fixed to the electric wire 3 such that the wire barrel portion 15 covers the bonded portion 11, the above stress particularly increases at an end (a rear end; a boundary between the bonded portion 11 and the conductor 13A in the non-bonded state) 11A of the bonded portion 11, for example, of the conductor 9.

In the terminal-equipped electric wire 1, the longitudinal direction of the electric wire 3 or the conductor 9 and the front-rear direction of the wire barrel portion 15 (terminal 5) coincide with each other as described above. In addition, one end of the electric wire 3 in the longitudinal direction is positioned on the front side, and the other end of the electric wire 3 in the longitudinal direction is positioned on the rear side.

A cross section (cross section taken along a plane orthogonal to the front-rear direction) of the wire barrel portion 15 before being crimped is formed in, for example, a "U" shape including a bottom plate portion (arc-shaped bottom plate portion) 23 whose thickness direction is substantially the height direction and a pair of side plate portions 25. The pair of side plate portions 25 is erected obliquely upward, respectively, from both ends of the bottom plate portion 23 in the width direction. A dimensional value of a portion between the pair of side plate portions 25 gradually increases from the lower side to the upper side.

A cross section (cross section taken along the plane orthogonal to the front-rear direction) of the insulation barrel portion 19 before being crimped is also formed in the "U" shape similar to the cross section of the wire barrel portion 15.

In the terminal-equipped electric wire 1, the bonded portion 11 and the wire barrel portion 15 are integrated as the wire barrel portion 15 is crimped, and the sheath 7 and the insulation barrel portion 19 are integrated as the insulation barrel portion 19 is crimped. Further, almost the entire inner surface of a cylinder of the wire barrel portion 15 is brought into contact with the bonded portion 11 with a biasing force by the crimping.

The crimping of the wire barrel portion 15 or the insulation barrel portion 19 is mainly performed as the pair of side plate portions 25 is plastically deformed so that the wire barrel portion 15 and the insulation barrel portion 19 are formed in a tubular shape. When the wire barrel portion 15 is crimped, the bonded portion 11 is also slightly deformed. The crimping of the wire barrel portion 15 is performed using a crimper (details of the crimper will be also described later) 27 illustrated in FIGS. 4A and 4B. As a result, the load release portion 21 is formed in a part of the wire barrel portion 15.

For example, the wire barrel portion 15 and the insulation barrel portion 19 are slightly apart from each other (a connection portion 29 is provided therebetween) in the front-rear direction, but the insulation barrel portion 19 is sometimes in contact with the wire barrel portion 15.

Here, a relationship between the electric wire 3 and the terminal 5 in the front-rear direction (the longitudinal direction in the electric wire 3) will be described in more detail. Although a bell mouth portion 43 is drawn in FIGS. 1 and 5, a description will be given here assuming that no bell mouth portion 43 is provided in order for convenience of the description As described above, the bonded portion 11 by the predetermined length, the conductor 13A in the non-bonded state, and the conductor 9 covered with the sheath 7 are arranged in this order from one end (front side) to the other end (rear side) in the longitudinal direction of the electric wire 3 A length of the conductor 9 covered with the sheath 7 is much longer than the bonded portion 11.

In the front-rear direction of the terminal 5, the mating terminal connection portion 17, the wire barrel portion 15, the connection portion 29, and the insulation barrel portion 19 are arranged in this order from the front side to the rear side. A value of a dimension of the wire barrel portion 15 in the front-rear direction is also larger than a value of a dimension of the connection portion 29 or the insulation barrel portion 19 in the front-rear direction.

Further, the terminal 5 is provided with the load release portion 21 at the rear end portion of the wire barrel portion 15.

In the terminal-equipped electric wire 1, the wire barrel portion 15 covers the bonded portion 11 such that the end (the other end; the rear end) 11A of the bonded portion 11 positioned on a side of the sheath 7 in the longitudinal direction is positioned to be closer to the sheath 7 (rear side) than an end (a rear end; a rear end 21B of the load release portion 21) 15A of the wire barrel portion 15 positioned on the side of the sheath 7 in the front-rear direction.

For example, an end (one end; a front end) 11B of the bonded portion 11 positioned on a side opposite to the sheath 7 is positioned further on a side opposite to the sheath 7 (front side) than an end (front end) 15B of the wire barrel portion 15 positioned on the side opposite to the sheath 7 in the longitudinal direction.

As a result, the wire barrel portion 15 is positioned at the inner side of the bonded portion 11 in the front-rear direction in the terminal-equipped electric wire 1.

In the terminal-equipped electric wire 1, the rear end 11A of the bonded portion 11 may be positioned on the front side of the rear end 15A of the wire barrel portion 15, or the front end 11B of the bonded portion 11 may be positioned on the rear side of the front end 15B of the wire barrel portion 15. Details thereof will be described later with reference to FIG. 7 and the like.

In the terminal-equipped electric wire 1, a value of a dimension between the rear end 11A of the bonded portion 11 and the rear end 15A of the wire barrel portion 15 in the front-rear direction is smaller than a value of a height of the bonded portion 11, and a value of a dimension (a value of a dimension of the conductor 13A in the non-bonded state) between the rear end 11A of the bonded portion 11 and the sheath 7 is also smaller than the value of the height of the bonded portion 11.

In the terminal-equipped electric wire 1, a position of an upper end in the height direction of the bonded portion 11 positioned at the load release portion 21 in the front-rear direction gradually shifts upward from the front to the rear. Further, the bonded portion 11 is in contact with at least a ceiling portion 25A of the load release portion 21.

More specifically, the wire barrel portion 15 includes a body portion 33 and the load release portion 21, and the load release portion 21 is provided in at least one end portion (for example, a rear end portion) of the body portion 33 in the front-rear direction (the longitudinal direction of the electric wire 3). As a result, the body portion 33 and the load release portion 21 are arranged in this order from the front side to the rear side in the front-rear direction.

The load release portion 21 is, for example, formed in a tapered shape, and an inner diameter of the load release portion 21 gradually increases from the front end (a boundary between the load release portion 21 and the body portion 33) of the load release portion 21 toward the rear end 15A (the rear end 21B of the load release portion 21) of the wire barrel portion 15.

However, a shape of the bottom plate portion 23 of the wire barrel portion 15 hardly changes in the front-rear direction and extends to be substantially straight. Therefore, a change of the inner diameter of the load release portion 21 is mainly caused in such a manner that a shape of the side plate portion 25 changes in the front-rear direction.

More specifically, the side plate portion 25 includes the ceiling portion 25A and an erected portion 25B in the terminal-equipped electric wire 1 as illustrated in FIG. 2. The ceiling portion 25A has an arc shape that is convex upward and opposes the bottom plate portion 23. The erected portions 25B are erected from both ends of the bottom plate portion 23 such that the thickness direction becomes the width direction.

As illustrated in FIG. 1, the ceiling portion 25A intersects with the front-rear direction at an angle θ. The angle θ is an acute angle, for example, an angle that is larger than 0° and equal to or smaller than 60°, more preferably an angle of 10° to 45°, and still more preferably 25° to 35°.

The entire erected portions 25B intersects with the front-rear direction at a predetermined angle (angle equal to or smaller than the angle θ), but only an upper portion (portion on a side of the ceiling portion 25A) may intersect with the front-rear direction at the predetermined angle. Incidentally, the intersection angle of the entire erected portion 25B with respect to the front-rear direction may be 0°.

Further, when the erected portion 25B intersects with the front-rear direction at the predetermined angle, a predetermined intersection angle at the erected portion 25B gradually increases, for example, from the lower side (a side of the bottom plate portion 23) to the upper side (the side of the ceiling portion 25A). In this case, the intersection angle of the erected portion 25B coincides with an intersection angle θ of the ceiling portion 25A at a boundary between the erected portion 25B and the ceiling portion 25A.

Further, when the entire erected portion 25B intersects with the front-rear direction at a predetermined angle and the intersection angle of the erected portion 25B gradually increases from the lower side to the upper side, the intersection angle of the erected portion 25B is 0° at a boundary between the erected portion 25B and the bottom plate portion 23.

When it is assumed that a diameter (conductor outer diameter) of the conductor 9 at a portion covered with the sheath 7 is d, a thickness (terminal plate thickness) of the terminal 5 is t, a height of the wire barrel portion 15 of the terminal 5 (height of wire barrel portion 15 after crimping, excluding a load release portion 21 described below) is Hc, and a height of a step of the load release portion 21 (step height of load release portion 21 with reference to the outer surface of the wire barrel portion 15 after crimping) is A in the terminal-equipped electric wire 1 as illustrated in FIG. 1, a relationship of $0<A\leq(d+2t)-Hc$ is satisfied in the terminal-equipped electric wire 1.

When it is further assumed that a height (a conductor height immediately after bonding) of the bonded portion 11 before fixing of the terminal 5 is H (see FIG. 3) and a height of the bonded portion 11 in a portion of the wire barrel portion 15 (the body portion 33 of the wire barrel portion 15) excluding the load release portion 21 after fixing of the terminal 5 is Hw in the terminal-equipped electric wire 1, a relationship of $H-Hw<A$ is satisfied.

Incidentally, the units of d, t, Hc, A, H, and Hw coincide with each other to be, for example, "mm".

Here, a method for manufacturing the terminal-equipped electric wire 1 will be described.

The terminal-equipped electric wire 1 is manufactured through a bonded portion formation step and a terminal fixing step.

In the bonded portion formation step, the conductor 9 is bonded by ultrasonically bonding the plurality of strands 13 for the conductor 9 to each other at a part of the exposed conductor 9A in the longitudinal direction of the electric wire 3 in which the conductor 9 is exposed due to the absence of the sheath 7 over a predetermined length in a part of the longitudinal direction, thereby forming the bonded portion 11 (see FIG. 3).

In the terminal fixing step, the terminal 5 having the wire barrel portion 15 is fixed to the electric wire 3 such that the wire barrel portion 15 wraps and covers at least a part of the bonded portion 11, after forming the bonded portion 11 in the above bonded portion formation step (see FIGS. 1 and 2).

The load release portion 21 is formed when the terminal 5 is fixed to the electric wire 3. That is, the load release portion 21 is formed when the wire barrel portion 15 is crimped using the crimper 27 (see FIGS. 4A and 4B), which will be described in detail later, so as to wrap and cover the bonded portion 11 with the wire barrel portion 15.

According to the terminal-equipped electric wire 1, the load release portion 21 configured to reduce the stress applied to the conductor 9 is provided at the rear end portion of the wire barrel portion 15, and thus, it is possible to reduce the stress generated in the conductor 9 (particularly the boundary between the bonded portion 11 and the conductor 13A in the non-bonded state) when the wire barrel portion 15 is crimped to be fixed or has been fixed to the bonded portion 11, and to suppress occurrence of strand breakage of the conductor 9.

As the strand breakage is suppressed in the terminal-equipped electric wire 1, the performance of a crimped portion is stabilized (the degree of mechanical bonding and the degree of electrical bonding between the electric wire 3 and the terminal 5 are stabilized), and the occurrence of contamination is suppressed.

In addition, when the bonded portion 11 is formed by ultrasonic bonding treatment, the strand 13 at the bonded portion 11 is more likely to be broken as compared to before the ultrasonic treatment due to the application of pressure and ultrasonic waves. However, the load release portion 21 is provided in the terminal-equipped electric wire 1, and thus, the strand 13 at the bonded portion 11 is hardly broken.

Further, according to the terminal-equipped electric wire 1, the diameter (inner diameter) of the load release portion 21 gradually increases (is formed in a tapered shape) from the body portion 33 toward the end (rear end) of the wire barrel portion 15, and thus, the bonded portion 11 engaged with the load release portion 21 gradually changes in diameter from the front to the rear.

As a result, it is possible to form the load release portion 21 with a simple configuration, and the stress generated in the conductor 9 can be reduced.

In the terminal-equipped electric wire 1, the rear end 21B of the load release portion 21 of the wire barrel portion 15 (the rear end 15A of the wire barrel portion 15) is present between a front end 21A of the load release portion 21 and a front end 13B of the conductor 13A in the non-bonded state in the front-rear direction.

Since the load release portion 21 is formed in the tapered shape, the bonded portion 11 between the front end 21A of the load release portion 21 and the front end 13B of the conductor 13A in the non-bonded state has a shape gradually changing from the front side to the rear side. As a result, it is possible to reduce the stress generated in the conductor 9 at the boundary between the bonded portion 11 and the conductor 13A in the non-bonded state.

Next, the crimper 27 will be described in detail with reference to FIGS. 4A and 4B.

The crimper 27 is a crimping tool used at the time of crimping and fixing the wire barrel portion 15 of the terminal 5 to the bonded portion 11 of the exposed conductor 13A of the electric wire 3, and includes a body portion (straight portion) 35 and an enlarged diameter portion 37.

It is configured such that the body portion 35 forms the body portion 33 of the wire barrel portion 15 of the terminal-equipped electric wire 1, and the enlarged diameter portion 37 forms the load release portion 21 of the wire barrel portion 15 of the terminal-equipped electric wire 1.

A concave portion 39, which has a certain shape when viewed from the longitudinal direction of the bonded portion 11 of the conductor 9 of the electric wire 3 (the front-rear direction of the terminal 5), is formed in the body portion 35.

The enlarged diameter portion 37 is provided to be adjacent to the body portion 35. The enlarged diameter portion 37 is enlarged in diameter as being away from the body portion 35 in the longitudinal direction in at least a part in the longitudinal direction. In a mode illustrated in FIGS. 4A and 4B, the diameter is enlarged as the enlarged diameter portion 37 is away from the body portion 35 over the entire length of the enlarged diameter portion 37 in the longitudinal direction.

Figure 4A:
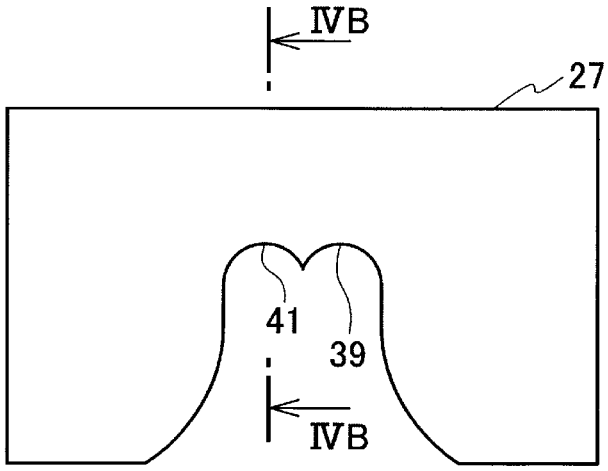
FIG. 4A is a view illustrating a schematic configuration of a crimper configured to crimp a wire barrel portion provided in the terminal of the terminal-equipped electric wire according to the embodiment of the invention.

Although not illustrated in FIG. 4A, the enlarged diameter portion 37 when viewed in the longitudinal direction of the bonded portion 11 bites into a thickness of the body portion 35 (above an edge 41) from at least a part of the edge 41 of the concave portion 39 of the body portion 35.

Figure 4B:
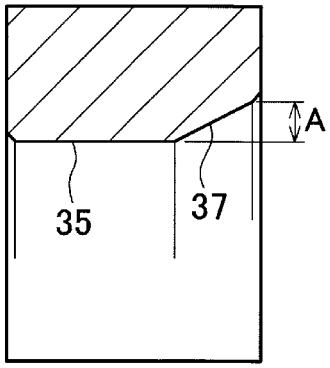
FIG. 4B is a view illustrating a cross section taken along line IVB-IVB in FIG. 4A.

More specifically, the enlarged diameter portion 37 is formed in a mode obtained by chamfering a longitudinal opening of the body portion 35 as illustrated in FIG. 4B. A dimension A illustrated in FIG. 4B corresponds to a dimension A illustrated in FIG. 1.

Figure 6A:
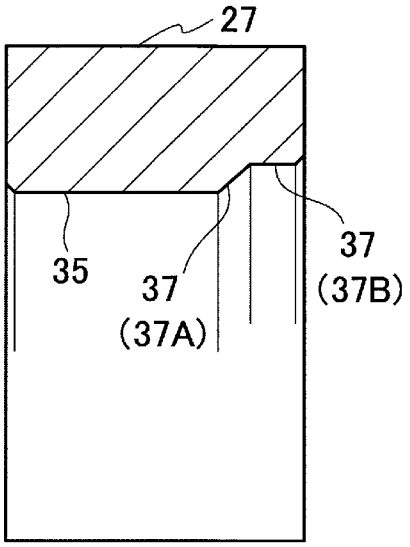
FIG. 6A is a view illustrating a schematic configuration of a crimper configured to crimp a wire barrel portion provided in a terminal of a terminal-equipped electric wire according to a first modification, the view corresponding to FIG. 4B.
Figure 6B:
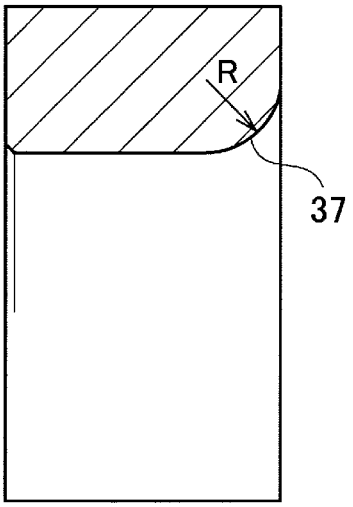
FIG. 6B is a view illustrating a schematic configuration of a crimper configured to crimp a wire barrel portion provided in a terminal of a terminal-equipped electric wire according to a second modification, the view corresponding to FIG. 4B.

Incidentally, the enlarged diameter portion 37 of the crimper 27 may have a shape as illustrated in FIG. 6A or 6B.

The enlarged diameter portion 37 illustrated in FIG. 6A is formed by a first enlarged diameter portion 37A and a second enlarged diameter portion 37B. The first enlarged diameter portion 37A on a side of the body portion 35 is gradually enlarged in diameter as being away from the body portion 35, which is similar to the enlarged diameter portion 37 illustrated in FIG. 4B. A diameter of the second enlarged diameter portion 37B, positioned on the side opposite to the body portion 35 with the first enlarged diameter portion 37A interposed therebetween, is constant.

In the enlarged diameter portion 37 illustrated in FIG. 6B, an increase ratio of the diameter also gradually increases as being away from the body portion 35. As a result, an arcuate portion having a radius R is formed.

Although it is assumed that there are no bell mouth portions at both the end portions of the wire barrel portion 15 in the front-rear direction in the above description, a description will be given regarding a case where the bell mouth portion 43 is provided at both the end portions of the wire barrel portion 15 in the front-rear direction.

In the terminal-equipped electric wire 1 illustrated in FIG. 1 and the like, the bell mouth portions 43 (a front bell mouth portion 43A and a rear bell mouth portion 43B) are formed at both the end portions of the wire barrel portion 15 in the front-rear direction. Therefore, the front bell mouth portion 43A, the body portion 33, the load release portion 21, and the rear bell mouth portion 43B are arranged in this order from the front side to the rear side in the wire barrel portion 15. The bell mouth portion 43 forms a part of the wire barrel portion 15.

Regarding, a value of a length in the front-rear direction, a value of the body portion 33 is the largest, a value of the load release portion 21 is the second largest, and a value of the front bell mouth portion 43A and a value of the rear bell mouth portion 43B are the smallest.

In the terminal-equipped electric wire 1, the front bell mouth portion 43A is formed in a tubular shape (a tapered shape or an inclined tubular shape) whose diameter gradually increases as being away from the body portion 33 (toward the front side). A diameter of a rear end of the front bell mouth portion 43A (a diameter at a boundary between the front bell mouth portion 43A and the body portion 33) coincides with the diameter of the body portion 33.

In the terminal-equipped electric wire 1, the rear bell mouth portion 43B is formed in a tubular shape (a tapered shape) whose diameter gradually increases as being away from the load release portion 21 (toward the rear side). A diameter of a front end of the rear bell mouth portion 43B (a diameter at a boundary between the rear bell mouth portion 43B and the load release portion 21) coincides with the diameter of the rear end 21B of the load release portion 21.

More specifically, a degree at which the diameter of the front bell mouth portion 43A or the rear bell mouth portion 43B increases (the intersection angle with respect to the front-rear direction) is larger than a degree at which the diameter of the load release portion 21 increases. That is, a value of the intersection angle θx in FIG. 1 is larger than a value of the intersection angle θ.

As illustrated in FIG. 5, a slight gap 45 is formed between the conductor 9 and the front bell mouth portion 43A at the front end (an opening at the front end) of the front bell mouth portion 43A, and the slight gap 45 is also formed between the conductor 9 and the rear bell mouth portion 43B at the rear end (an opening at the rear end) of the rear bell mouth portion 43B.

Incidentally, it may be configured in such a manner that the front bell mouth portion 43A and the conductor 9 are in contact with each other at the front end (the opening at the front end) of the front bell mouth portion 43A so that the front bell mouth portion 43A restrains the conductor 9, and the rear bell mouth portion 43B and the conductor 9 are in contact with each other at the rear end (the opening at the rear end) of the rear bell mouth portion 43B so that the rear bell mouth portion 43B restrains the conductor 9.

Meanwhile, the bonded portion 11 protrudes from the wire barrel portion 15 in the front-rear direction in the terminal-equipped electric wire 1 illustrated in FIG. 1 and the like, but an end of the bonded portion 11 may be accommodated in the wire barrel portion 15.

Figure 7:
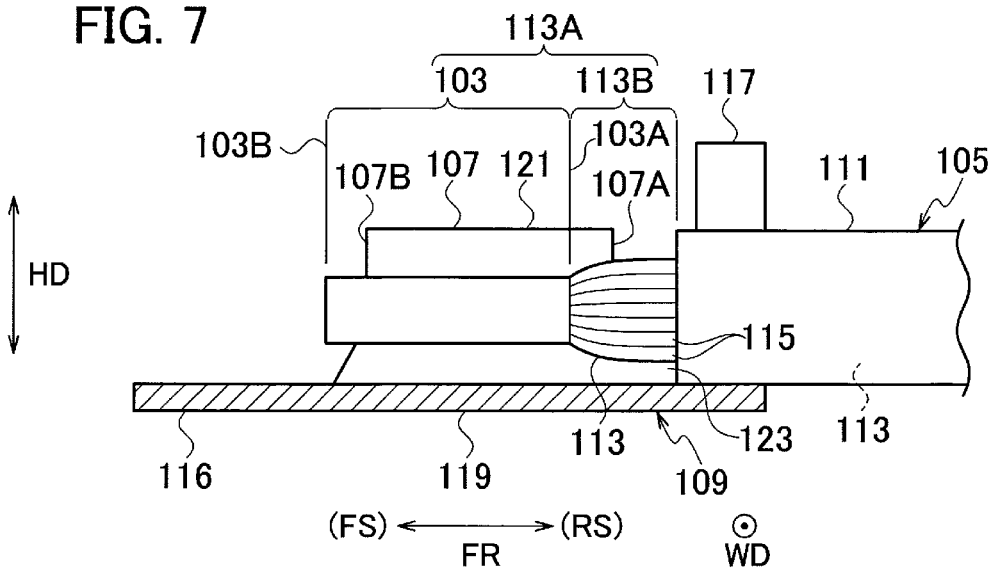
FIG. 7 is a view illustrating a state before fixing a terminal to an electric wire in a terminal-equipped electric wire according to a modification.
Figure 8:
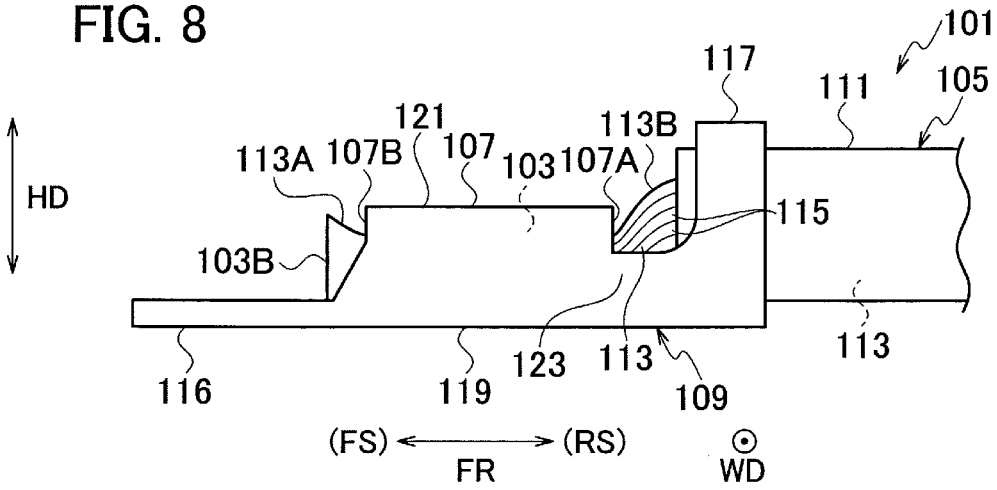
FIG. 8 is a view illustrating a schematic configuration of the terminal-equipped electric wire according to the modification.
Figure 9:
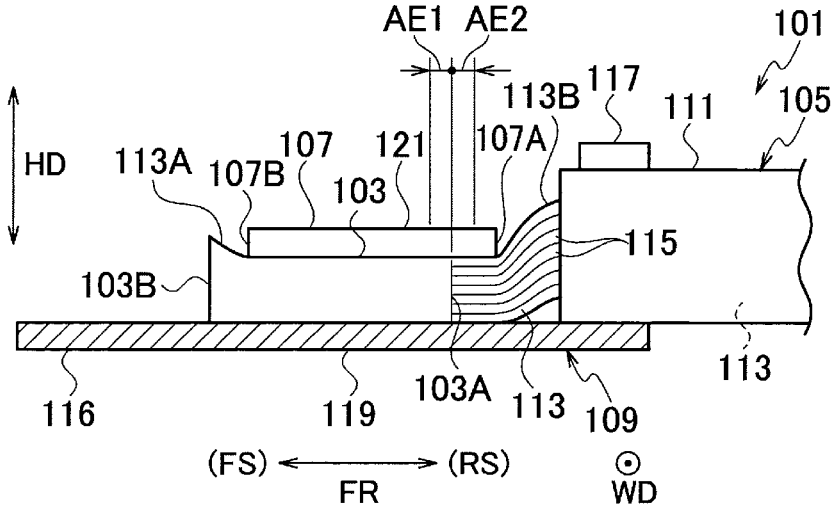
FIG. 9 is a cross-sectional view illustrating the schematic configuration of the terminal-equipped electric wire according to the modification.

For example, as illustrated in FIGS. 7 to 9, an end (rear end) 107A of a wire barrel portion 107 (the wire barrel portion 15) positioned on a side of a sheath 111 (the sheath 7) may be positioned to be closer to the sheath 111 than an end (rear end) 103A of a bonded portion 103 (the bonded portion 11) positioned on the side of the sheath 111 in a terminal-equipped electric wire 101 (the terminal-equipped electric wire 1).

Figure 10:
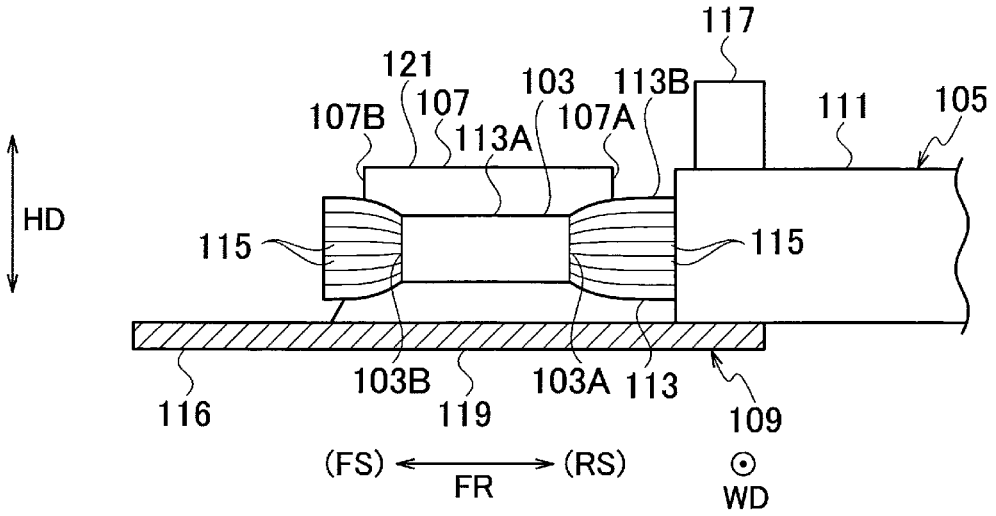
FIG. 10 is a view illustrating a state before fixing a terminal to a wire in a terminal-equipped electric wire according to another modification.
Figure 11:
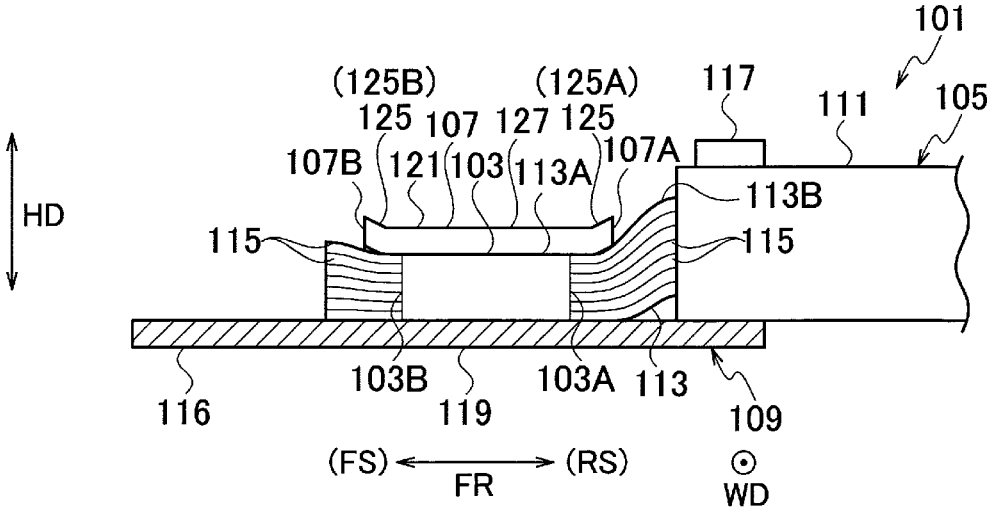
FIG. 11 is a cross-sectional view illustrating a schematic configuration of the terminal-equipped electric wire according to another modification.

Further, the bonded portion 103 may be positioned at the inner side of the wire barrel portion 107 in the front-rear direction as illustrated in FIGS. 10 and 11.

FIGS. 7 to 11 do not illustrate the load release portion 21, and no bell mouth portion is provided in those illustrated in FIGS. 7 to 9.

Here, the terminal-equipped electric wire 101 illustrated in FIGS. 7 to 9 will be described in detail.

The terminal-equipped electric wire 101 includes an electric wire 105 (the electric wire 3) in which the bonded portion 103 is formed and a terminal (terminal fitting) 109 (the terminal 5) having the wire barrel portion 107 (the wire barrel portion 15).

As described above, the sheath 111 is not present over a predetermined length at a part (for example, one end portion) in the longitudinal direction (length direction) (for example, a part of the sheath 111 is removed) so that a conductor 113 (the conductor 9) is exposed in the electric wire 105.

Further, the bonded portion 103 where the conductor 113 is bonded to a part of an exposed conductor (exposed conductor) 113A is formed over a predetermined length in the electric wire 105. The bonded portion 103 is formed by, for example, ultrasonically bonding a plurality of strands 115 (the strands 13) for the conductor 113 to each other.

More specifically, the electric wire 105 includes the conductor (core wire) 113 formed by gathering the plurality of strands 115 and the sheath (insulator) 111 covering (coating) the conductor 113.

The strand 115 of the conductor 113 is formed in an elongated cylindrical shape with metal such as copper, aluminum, and an aluminum alloy. The conductor 113 is configured in a form in which the plurality of strands 115 is twisted or a form in which the plurality of strands 115 collectively extends in a straight line.

Further, the electric wire 105 has flexibility. A cross section of a portion of the electric wire 105 where the sheath 111 is present (the cross section taken along a plane orthogonal to the longitudinal direction) is formed in a predetermined shape such as a circular shape.

A cross section of the conductor 113 at the portion of the electric wire 105 where the sheath 111 is present is formed, for example, in a substantially circular shape by bundling the plurality of strands 115 with almost no gap. A cross section of the sheath 111 at the portion of the electric wire 105 where the sheath 111 is present is formed, for example, in an annular shape having a predetermined width (thickness). The entire inner circumference of the sheath 111 is in contact with the entire outer circumference of the conductor 113.

In the bonded portion 103, the plurality of strands 115 for the conductor 113 is ultrasonically bonded to each other as described above such that the conductor 113 is bonded to each other.

Although the bonded portion 103 is formed by the ultrasonic bonding in the above description, the bonded portion 103 may be formed by bonding the strands 115 to each other by a bonding means other than the ultrasonic bonding. For example, the bonded portion 103 may be formed in the same manner as in the case of ultrasonic bonding by metallurgically bonding the strands 115 to each other at a temperature equal to or lower than a recrystallization temperature of the strand 115.

The bonded portion 103 and the sheath 111 are apart from each other by a predetermined length, for example, in the longitudinal direction of the electric wire 105. As a result, a plurality of the strands (a conductor 113B in a non-bonded state), which is in contact with each other but is in a non-bonded state, is exposed between the bonded portion 103 and the sheath 111.

That is, the bonded portion 103 having the predetermined length, the conductor 113B in the non-bonded state, the conductor 113 covered with the sheath 111 (a portion of the electric wire 105 where the sheath 111 is present) are arranged in this order from one end to the other end in the longitudinal direction of the electric wire 105.

A sectional shape (sectional shape taken along a plane orthogonal to the longitudinal direction) of the bonded portion 103 before fixing of the terminal 109 is formed in a predetermined shape such as a rectangular shape.

Further, a sectional shape (sectional shape taken along the plane orthogonal to the longitudinal direction) of the conductor 113B in a non-bonded state before fixing of the terminal 109 gradually shifts from the sectional shape of the bonded portion 103 to a sectional shape of the conductor 113 covered with the sheath 111.

In the terminal-equipped electric wire 101, the longitudinal direction of the electric wire 105 or the conductor 113 and the front-rear direction of the wire barrel portion 107 (the terminal 109) coincide with each other. In addition, one end of the electric wire 105 in the longitudinal direction is positioned on the front side, and the other end of the electric wire 105 in the longitudinal direction is positioned on the rear side.

In the terminal-equipped electric wire 101, an end (a rear end; an end positioned on a side of the sheath 111 in the front-rear direction) 107A of the wire barrel portion 107 of the terminal 109 is positioned to be closer to the sheath 111 (the rear side) than an end (a rear end; an end positioned on the side of the sheath 111 in the longitudinal direction) 103A of the bonded portion 103. In the terminal-equipped electric wire 101, the wire barrel portion 107 wraps and covers at least a part of the bonded portion 103, for example, by crimping the wire barrel portion 107.

The terminal 109 is formed, for example, by forming a flat metal material into a predetermined shape, and then, folding the material formed in the predetermined shape.

The terminal 109 has, for example, a terminal connection portion 116 (the mating terminal connection portion 17) to be connected to a mating terminal, the wire barrel portion 107, and an insulation barrel portion 117 (the insulation barrel portion 19) are arranged in this order from the front side to the rear side.

A sectional shape (section shape taken along a plane orthogonal to the front-rear direction) of the wire barrel portion 107 before being crimped is formed in, for example, a "U" shape including a bottom plate portion (arc-shaped bottom plate portion) 119 whose thickness direction is substantially the height direction and a pair of side plate portions 121. The pair of side plate portions 121 is erected obliquely upward, respectively, from both ends of the bottom plate portion 119 in the width direction. A dimensional value (dimensional value in the width direction) of a portion between the pair of side plate portions 121 gradually increases from the lower side to the upper side.

A sectional shape (sectional shape taken along the plane orthogonal to the front-rear direction) of the insulation barrel portion 117 before being crimped is also formed in the "U" shape similar to the cross section of the wire barrel portion 107.

In the terminal-equipped electric wire 101, the bonded portion 103 and the wire barrel portion 107 are integrated as the wire barrel portion 107 is crimped, and the sheath 111 and the insulation barrel portion 117 are integrated as the insulation barrel portion 117 is crimped.

The crimping of the wire barrel portion 107 or the insulation barrel portion 117 is mainly performed as the pair of side plate portions 121 is plastically deformed so that the wire barrel portion 107 and the insulation barrel portion 117 are formed in a tubular shape. The bonded portion 103 is deformed as the wire barrel portion 107 is crimped.

For example, the wire barrel portion 107 and the insulation barrel portion 117 are slightly apart from each other (a connection portion 123 is provided therebetween) in the front-rear direction, but the insulation barrel portion 117 may be in contact with the wire barrel portion 107.

Here, a relationship between the electric wire 105 and the terminal 109 in the front-rear direction will be described in more detail.

In the longitudinal direction of the electric wire 105, the bonded portion 103 by the predetermined length, the conductor 113B in the non-bonded state, and the conductor 113 covered with the sheath 111 are arranged in this order from the front side to the rear side as described above. A length of the conductor 113 covered with the sheath 111 is much longer than the length of the bonded portion 103 or the conductor 113B in the non-bonded state.

In the front-rear direction of the terminal 109, the terminal connection portion 116, the wire barrel portion 107, the connection portion 123 between the wire barrel portion 107 and the insulation barrel portion 117, and the insulation barrel portion 117 are arranged is in this order from the front side to the rear side as described above. A value of a dimension of the wire barrel portion 107 in the front-rear direction is larger than a value of a dimension of the connection portion 123 or the insulation barrel portion 117 in the front-rear direction.

In the terminal-equipped electric wire 101, one end (front end) 103B of the bonded portion 103 is positioned slightly at the front side of a front end 107B of the wire barrel portion 107 in the front-rear direction as illustrated in FIG. 9. Thus, one end portion of the bonded portion 103 protrudes slightly to the front side from the front end 107B of the wire barrel portion 107. A value of a protruding dimension of the bonded portion 103 from the wire barrel portion 107 (protruding amount to the front side) is smaller than a value of a height of the bonded portion 103.

The one end (front end) 103B of the bonded portion 103 may be positioned slightly at the rear side of the front end 107B of the wire barrel portion 107.

The other end (rear end) 103A of the bonded portion 103 is positioned slightly at the front side of the rear end 107A of the wire barrel portion 107. As a result, a front end portion of the conductor 113B in the non-bonded state between the bonded portion 103 and the sheath 111 is wrapped by the wire barrel portion 107.

A value of a dimension (a value of a dimension in the front-rear direction) between the rear end 103A of the bonded portion 103 and the rear end 107A of the wire barrel portion 107 is also smaller than the value of the height of the bonded portion 103.

In the terminal-equipped electric wire 101, a value of a height of the conductor 113B in the non-bonded state gradually increases from the front side to the rear side. A front end of the sheath 111 of the electric wire 105 (the rear end of the conductor 113B in the non-bonded state) is positioned slightly at the front side of a front end of the insulation barrel portion 117.

Here, the load release portion 21 that is not illustrated in FIGS. 8 and 9 will be described. When the load release portion 21 is provided in the terminal-equipped electric wire 101 illustrated in FIG. 8 or 9, a position of a rear end of the load release portion 21 coincides with a position of the rear end 107A of the wire barrel portion 107 in the front-rear direction, and a front end of the load release portion 21 is present within a region AE1 or a region AE2 illustrated in FIG. 9.

In the front-rear direction, a position of a rear end of the region AE1 coincides with a position of the rear end 103A of the bonded portion 103, and a front end of the region AE1 is positioned at an intermediate portion of the wire barrel portion 107 (an intermediate portion on the front side of the rear end 103A of the bonded portion 103).

In the front-rear direction, a position of a front end of the region AE2 coincides with the position of the rear end 103A of the bonded portion 103, and a rear end of the region AE2 is positioned at the rear side of the wire barrel portion 107 (an intermediate portion between the rear end 103A of the bonded portion 103 and the sheath 111).

When the front end 21A of the load release portion 21 is present within the region AE1, the rear end 103A of the bonded portion 103 is accommodated in the load release portion 21 in the front-rear direction.

When the front end 21A of the load release portion 21 is present within the region AE2, the rear end 103A of the bonded portion 103 is positioned on the front side of the load release portion 21 in the front-rear direction.

According to the terminal-equipped electric wire 101, the wire barrel portion 107 covers the bonded portion 103 such that the rear end 107A of the wire barrel portion 107 is positioned at the rear side of the rear end 103A of the bonded portion 103, and thus, it is possible to suppress occurrence of breakage of the strand 115 at the boundary portion of the bonded portion 103 (a boundary between the bonded portion 103 and the conductor 113B in the non-bonded state) 103A.

Figure 17:
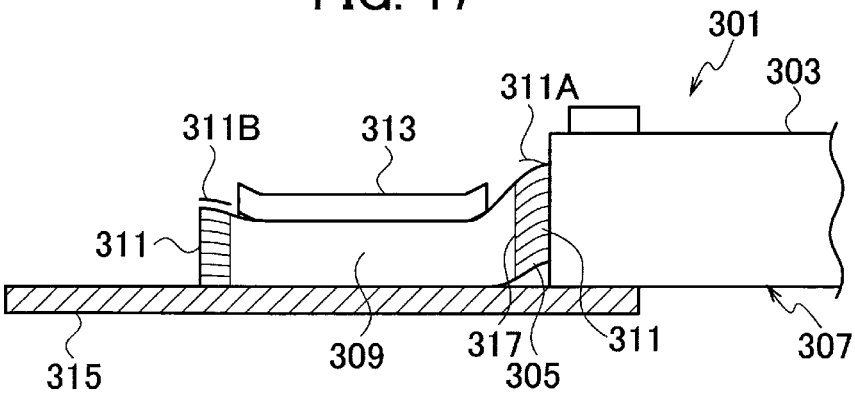
FIG. 17 is a view illustrating the conventional terminal-equipped electric wire.
Figure 18A:
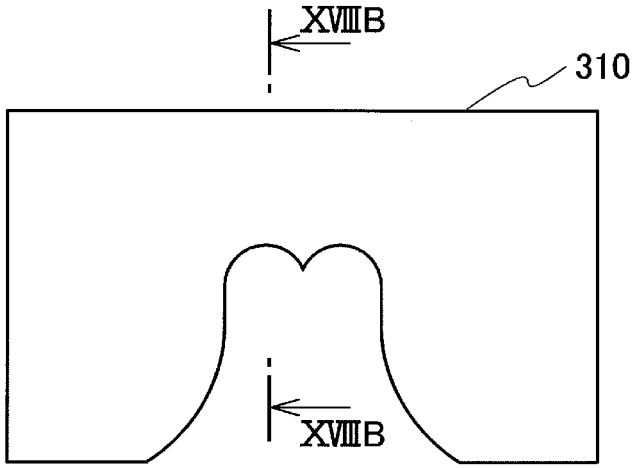
FIG. 18A is a view illustrating a conventional crimper.
Figure 18B:
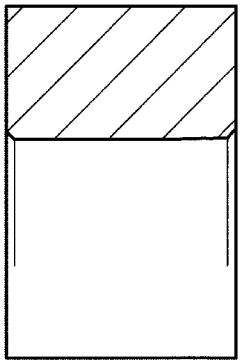
FIG. 18B is a cross-sectional view taken along line XVIIIB-XVIIIB in FIG. 18A.

That is, when the wire barrel portion 107 is crimped to the electric wire 105 in which the bonded portion 103 has been formed to crimp the terminal 109, the rear end (the boundary portion between the bonded portion and the conductor in the non-bonded state) 103A of the bonded portion 103 is positioned within the wire barrel portion 107, and thus, the boundary portion 103A is hardly pulled by crimping of the terminal 109, and it is possible to suppress the occurrence of breakage of the core wire at the boundary portion 103A (breakage of the strand 115 in the conductor 113B in the non-bonded state; breakage of the strand indicated by a reference signs 311A and 311B in FIG. 17).

As the strand breakage is suppressed, the performance of the crimped portion is stabilized (the degree of mechanical bonding and the degree of electrical bonding between the electric wire 105 and the terminal 109 are stabilized), and the occurrence of contamination is suppressed.

In the above description, the bonded portion 103 slightly protrudes to the front side from the front end 107B of the wire barrel portion 107 as illustrated in FIG. 9 and the like, but the front end 107B of the wire barrel portion 107 may be positioned on the front side of the front end 103B of the bonded portion 103 as illustrated in FIGS. 10 and 11. That is, the value of the dimension of the wire barrel portion 107 in the front-rear direction may be larger than the value of the dimension of the bonded portion 103 in the front-rear direction, and the bonded portion 103 may be positioned at the inner side of the wire barrel portion 107 in the front-rear direction.

Meanwhile, the terminal-equipped electric wire 101 illustrated in FIG. 11 is provided with a bell mouth portion 125 (bell mouth portion 43). In this case, the bell mouth portion 125 is provided in a mode of protruding to the rear side from the rear end 107A of the wire barrel portion 107 of the terminal-equipped electric wire 101 illustrated in FIGS. 7 to 9 and a mode of protruding to the front side from the front end 107B of the wire barrel portion 107 of the terminal-equipped electric wire 101 illustrated in FIGS. 7 to 9.

In the terminal-equipped electric wire 101 illustrated in FIG. 10 or 11, the wire barrel portion 107 includes a body portion 127 and a pair of the bell mouth portions 125 (a rear bell mouth portion 125A and a front bell mouth portion 125B). In the front-rear direction, the front bell mouth portion 125B, the body portion 127, and the rear bell mouth portion 125A are arranged in this order from the front side to the rear side.

More specifically, the bell mouth portion 125 (the rear bell mouth portion 125A) is formed at an end portion (rear end portion) of the wire barrel portion 107 positioned on the side of the sheath 111.

In the terminal-equipped electric wire 101 illustrated in FIG. 10 or 11, a front end of the rear bell mouth portion 125A (an end on the opposite side of the rear end positioned on the side of the sheath 111 in the front-rear direction; a boundary between the rear bell mouth portion 125A and the body portion 127) is positioned to be closer to the sheath 111 (the rear side) than the rear end (the end positioned on the side of the sheath 111 in the longitudinal direction) 103A of the bonded portion 103.

In the terminal-equipped electric wire 101 illustrated in FIG. 10 or 11, the body portion 127 of the wire barrel portion 107 is formed in a tubular shape whose diameter is substantially constant in the front-rear direction, and the rear bell mouth portion 125A is formed in a tubular shape whose diameter gradually increases as being apart from the body portion 127 (from the front side to the rear side). A diameter of the front end of the rear bell mouth portion 125A (a diameter at the boundary between the rear bell mount portion 125A and the body portion 127) coincides with the diameter of the body portion 127.

In the terminal-equipped electric wire 101 illustrated in FIG. 10 or 11, the front bell mouth portion 125B is formed in a tubular shape whose diameter gradually increases as being apart from the body portion 127 (from the rear side to the front side), which is similar to the rear bell mouth portion 125A.

In the terminal-equipped electric wire 101 illustrated in FIG. 10 or 11, a dimension of the front bell mouth portion 125B in the front-rear direction and a dimension of the rear bell mouth portion 125A in the front-rear direction are smaller than the value of the height of the bonded portion 103, and a dimension of the body portion 127 of the wire barrel portion 107 in the front-rear direction is larger than the value of the height of the bonded portion 103.

In the terminal-equipped electric wire 101 illustrated in FIG. 10 or 11, a value of a height or a diameter of the conductor 113 present between the body portion 127 of the wire barrel portion 107 and the sheath 111 (the conductor 113B in the non-bonded state at the rear side positioned between the front end of the rear bell mouth portion 125A and the sheath 111) gradually increases toward the rear side in the front-rear direction.

In the terminal-equipped electric wire 101 illustrated in FIG. 10 or 11, the conductor (the conductor in the non-bonded state at the front side) 113B in the non-bonded state protrudes to the front side from the front end of the bonded portion 103 of the electric wire 105 by a predetermined length.

As a result, in the terminal-equipped electric wire 101 illustrated in FIG. 10 or 11, the rear end (the boundary between the conductor 113B in the non-bonded state at the front side and the bonded portion 103) of the conductor 113B in the non-bonded state at the front side is positioned at the rear side of the rear end of the front bell mouth portion 125B, and the front end of the conductor 113B in the non-bonded state at the front side is positioned at the front side of the front end of the front bell mouth portion 125B in the front-rear direction.

Figure 12:
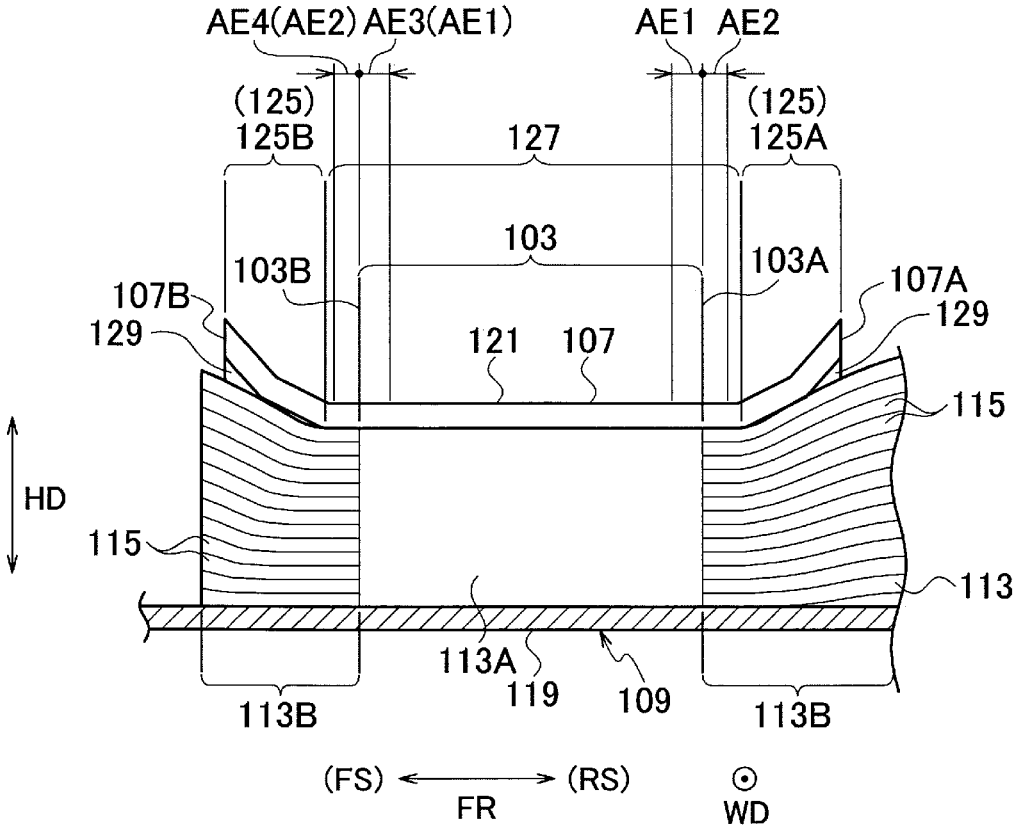
FIG. 12 is a view schematically illustrating the terminal-equipped electric wire of FIG. 11.

Further, a slight gap 129 (slight gap 45) is formed between the conductor 113 (conductor 113B in the non-bonded state at the front side) and the front bell mouth portion 125B at the front end (opening at the front end) of the front bell mouth portion 125B, and the slight gap 129 (slight gap 45) is also formed between the conductor 113 and the rear bell mouth portion 125A at the rear end (opening at the rear end) of the rear bell mouth portion 125A as illustrated in FIG. 12.

Incidentally, it may be configured in such a manner that the front bell mouth portion 125B and the conductor 113 are in contact with each other at the front end (opening at the front end) of the front bell mouth portion 125B so that the front bell mouth portion 125B restrains the conductor 113, and the rear bell mouth portion 125A and the conductor 113 are in contact with each other at the rear end (opening at the rear end) of the rear bell mouth portion 125A so that the rear bell mouth portion 125A restrains the conductor 113.

Further, in the terminal-equipped electric wire 1 illustrated in FIG. 1 or 2 and in the terminal-equipped electric wire 101 illustrated in FIG. 11 or 12, any one of the rear bell mouth portions 43B, 125A and the front bell mouth portions 43A, 125B may be deleted. For example, the front bell mouth portions 43A and 125B may be deleted.

According to the terminal-equipped electric wire 101 illustrated in FIG. 11 or 12, the bonded portion 103 is positioned at the inner side of the body portion (body portion excluding the bell mouth portion 125) 127 of the wire barrel portion 107, and thus, it is possible to suppress the occurrence of conductor breakage when the terminal 109 is fixed to the electric wire 105.

Further, a part of the conductor 113B in the non-bonded state (a portion on the side of the bonded portion 103) is accommodated in the bell mouth portion 125 according to the terminal-equipped electric wire 101 illustrated in FIG. 11 or 12, and thus, it is possible to further suppress the occurrence of conductor breakage at the boundary portion between the bonded portion 103 and the conductor 113B in the non-bonded state.

Although the bonded portion 103 is positioned at the inner side of the body portion 127 of the wire barrel portion 107 in the terminal-equipped electric wire 101 illustrated in FIG. 11 or 12 provided with the bell mouth portion 125, the front end 103B of the bonded portion 103 may be positioned at an intermediate portion of the front bell mouth portion 125B and the rear end 103A of the bonded portion 103 may be positioned in an intermediate portion of the rear bell mouth portion 125A in the front-rear direction.

Figure 13:
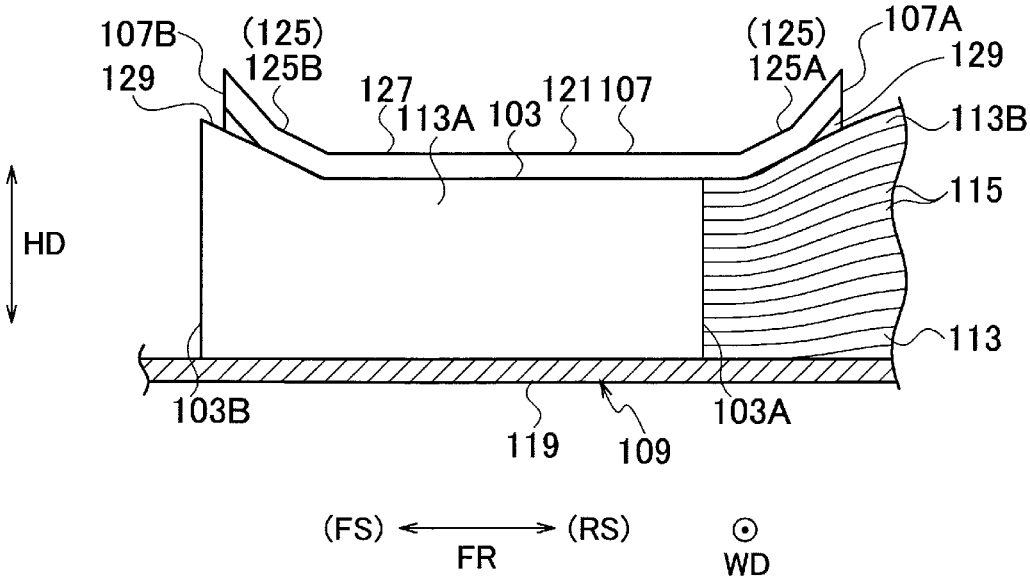
FIG. 13 is a view schematically illustrating a modification of the terminal-equipped electric wire of FIG. 11.

Alternatively, the conductor 113B in the non-bonded state at the front side may be deleted as illustrated in FIG. 13. Although the front end of the bonded portion 103 is positioned at the front side of the front end of the front bell mouth portion 125B in the terminal-equipped electric wire 101 illustrated in FIG. 13, the front end of the bonded portion 103 may be positioned at the rear side of the rear end of the front bell mouth portion 125B and the front end of the bonded portion 103 may be positioned at the front bell mouth portion 125B.

Although the conductor 113B in the non-bonded state protrudes slightly to the front side from the front end 103B of the bonded portion 103 in FIG. 12, the conductor 113B in the non-bonded state protruding to the front side from the front end 103B of the bonded portion 103 may be deleted.

According to the terminal-equipped electric wire 101 illustrated in FIG. 12, the bonded portion 103 is positioned at the inner side of the wire barrel portion 107 in the front-rear direction, and thus, it is possible to suppress the occurrence of strand breakage at both the ends (the rear end 103A and the front end 103B) of the bonded portion 103.

Here, the load release portion 21 that is not illustrated in FIGS. 11 and 12 will be described. When the load release portion 21 is provided at a rear end portion of the wire barrel portion 107 provided in the terminal 109 of the terminal-equipped electric wire 101 illustrated in FIG. 11 or 12, a position of the rear end 21B of the load release portion 21 coincides with a position of a front end of the rear bell mouth portion 125A in the front-rear direction, and the front end 21A of the load release portion 21 is present within the region AE1 or the region AE2 illustrated in FIG. 12.

When the load release portion 21 is provided at a front end portion of the wire barrel portion 107 provided in the terminal 109 of the terminal-equipped electric wire 101 illustrated in FIG. 11 or 12, a position of the front end of the load release portion 21 coincides with a position of a front end of the front bell mouth portion 125B in the front-rear direction, and the rear end of the load release portion 21 is present within a region AE3 (AE1) or a region AE4 (AE2).

Figure 14:
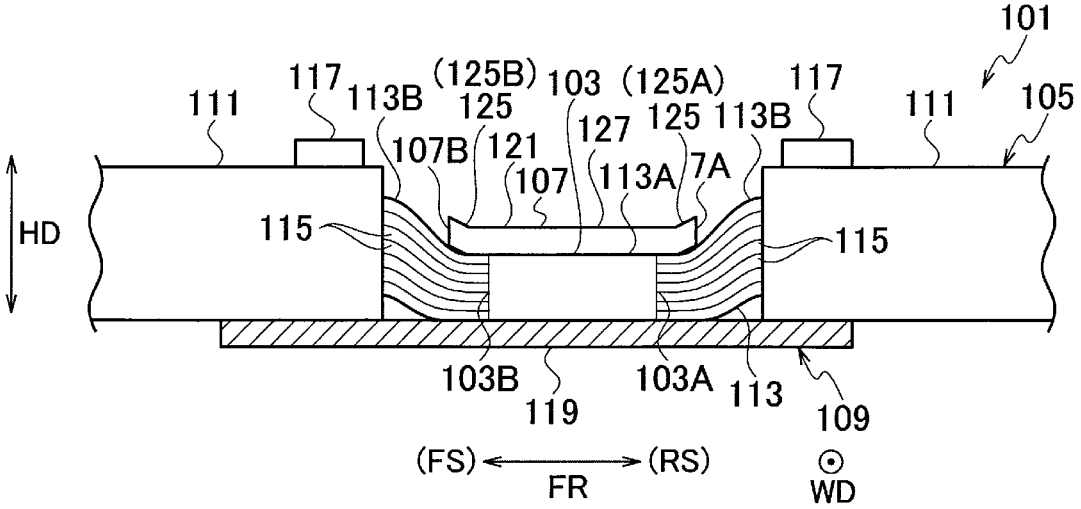
FIG. 14 is a view illustrating a terminal-equipped electric wire according to a modification in which a bonded portion is formed at an intermediate portion in the longitudinal direction of an electric wire and a terminal is fixed to the bonded portion.

Although the bonded portion 103 is formed at one end portion of the electric wire 105 in the longitudinal direction and the terminal 109 is fixed to the bonded portion 103 in the above description, the bonded portion 103 may be formed at an intermediate portion of the electric wire 105 in the longitudinal direction, and the terminal 109 may be fixed to the bonded portion 103 as illustrated in FIG. 14.

More specifically, the terminal 109 may be fixed to the bonded portion 103 of the electric wire in which the conductor 113 covered with the sheath 111 (an one-end-side portion of the electric wire where the sheath is present), the conductor 113B in the non-bonded state (conductor in the non-bonded state at one end side), the bonded portion 103, the conductor 113B in the non-bonded state (conductor in the non-bonded state at the other end side), and the conductor 113 covered with the sheath 111 (an other-end-side portion of the electric wire where the sheath is present) are arranged in this order from one side to the other side in the longitudinal direction of the electric wire 105.

In such a terminal-equipped electric wire, a value of a length of the wire barrel portion 107 (or the body portion 127 of the wire barrel portion) of the terminal 109 in the longitudinal direction of the electric wire 105 (the front-rear direction of the terminal 109) is larger than a value of a length of the bonded portion 103, and the bonded portion 103 is positioned at the inner side of the wire barrel portion 107 (or the body portion 127 of the wire barrel portion) of the terminal 109 in the longitudinal direction of the electric wire 105 (the front-rear direction of the terminal 109).

Figure 15:
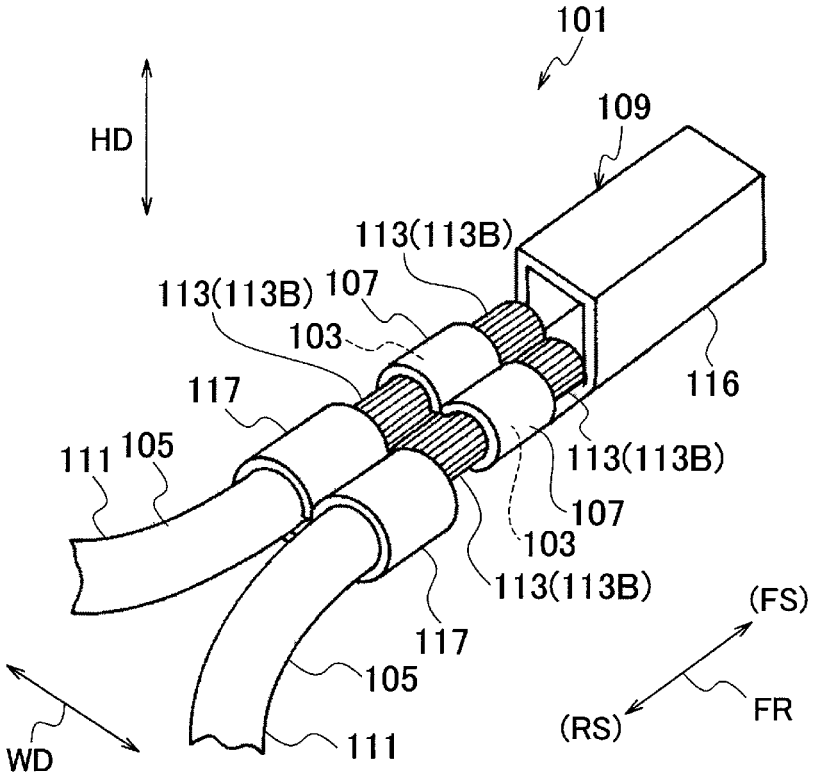
FIG. 15 is a view illustrating a terminal-equipped electric wire according to a modification in which one terminal is fixed to a plurality of (for example, two) electric wires.
Figure 16A:
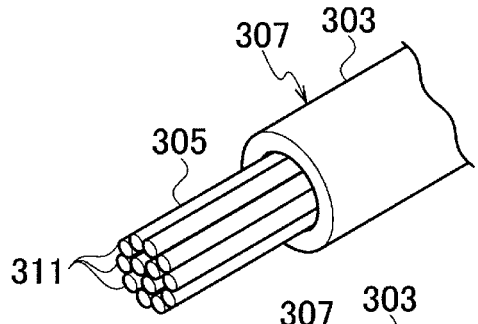
FIG. 16A is a view illustrating a conventional terminal-equipped electric wire.
Figure 16B:
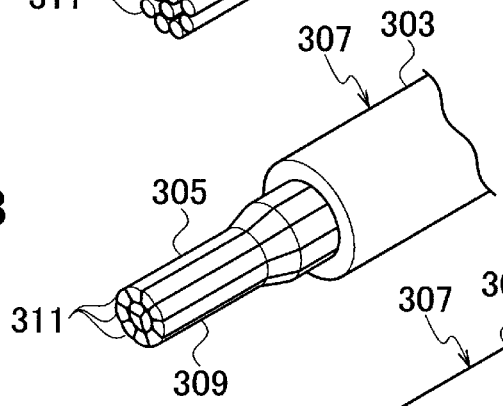
FIG. 16B is a view illustrating a conventional terminal-equipped electric wire.
Figure 16C:
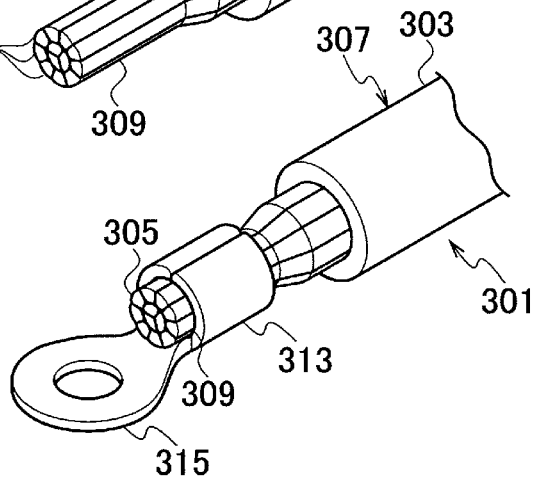
FIG. 16C is a view illustrating a conventional terminal-equipped electric wire.

Further, the single terminal 109 is fixed to the single electric wire 105 in the above description, but one terminal 109 may be fixed to a plurality of (for example, two) electric wires 105 as illustrated in FIG. 15. That is, the wire barrel portion 107 may be provided at the bonded portion 103 of each electric wire 105 in the same manner as the above-described case.

Further, when the one terminal 109 is fixed to the plurality of electric wires 105, the bonded portion 103 may be formed individually in each of the conductors 113 of the electric wires 105 and the one terminal 109 may be fixed to each of the electric wires 105, or alternatively, the conductors 113 of at least two electric wires 105 among the respective electric wires 105 may be collected to form the bonded portion 103 at such a collected portion and the one terminal 109 may be fixed to the respective electric wires 105.

Further, when the one terminal 109 is fixed to the plurality of electric wires 105, at least one electric wire 105 among the respective electric wires 105 may have a form in which the bonded portion 103 is formed at an intermediate portion of the electric wire 105 in the longitudinal direction.

What is claimed is:

1. A terminal-equipped electric wire comprising:

an electric wire including a bonded portion formed at a part of a conductor exposed due to absence of a sheath at a part of the electric wire in a longitudinal direction and in which strands of the conductor are bonded to each other; and a terminal including a wire barrel portion, the wire barrel portion covering at least a of the bonded portion, wherein the wire barrel portion is provided with a load release portion configured to reduce stress applied to the conductor, and wherein a relationship of $0<A\leq(d+2t)-Hc$ is satisfied when a diameter of the conductor at a portion covered with the sheath is d, a thickness of the terminal is t, a height of the wire barrel portion of the terminal is Hc, and a height of a step of the load release portion is A.

2. The terminal-equipped electric wire according to claim 1, wherein the load release portion is provided in at least one end portion of the wire barrel portion, and a diameter of the load release portion gradually increases toward an end of the wire barrel portion.

3. The terminal-equipped electric wire according to claim 1, wherein a relationship of $H-Hw<A$ is satisfied when a height of the bonded portion before the fixing of the terminal is H and a height of the bonded portion at a portion of the wire barrel portion excluding the load release portion after the fixing of the terminal is Hw.

4. The terminal-equipped electric wire according to claim 1, wherein an end of the wire barrel portion positioned on a side of the sheath is positioned to be closer to the sheath than an end of the bonded portion positioned on the side of the sheath.

5. The terminal-equipped electric wire according to claim 4, wherein the longitudinal direction of the electric wire and a front-rear direction of the wire barrel portion coincide with each other, and the bonded portion is positioned at an inner side of the wire barrel portion in the front-rear direction.

6. The terminal-equipped electric wire according to claim 1, wherein one terminal of the terminal is fixed to a plurality of the electric wires.

7. A terminal-equipped electric wire comprising:

an electric wire including a bonded portion formed at a part of a conductor exposed due to absence of a sheath at a part of the electric wire in a longitudinal direction and in which strands of the conductor are bonded to each other; and a terminal including a wire barrel portion, the wire barrel portion covering at least a of the bonded portion, wherein an end portion of the wire barrel portion gradually increases in diameter toward an end of the wire barrel portion, and wherein a relationship of $0<A\leq(d+2t)-Hc$ is satisfied when a diameter of the conductor at a portion covered with the sheath is d, a thickness of the terminal is t, a height of the wire barrel portion of the terminal is Hc, and a height of a step of the load release portion is A.

8. The terminal-equipped electric wire according to claim 7, wherein an end of the wire barrel portion positioned on a side of the sheath is positioned to be closer to the sheath than an end of the bonded portion positioned on the side of the sheath.

9. The terminal-equipped electric wire according to claim 8, wherein the longitudinal direction of the electric wire and a front-rear direction of the wire barrel portion coincide with each other, and the bonded portion is positioned at an inner side of the wire barrel portion in the front-rear direction.

10. The terminal-equipped electric wire according to claim 7, wherein one terminal of the terminal is fixed to a plurality of the electric wires.

11. A method for manufacturing a terminal-equipped electric wire, the method comprising:

forming, in an electric wire, a bonded portion in which strands of a conductor are bonded to each other at a part of the conductor in a longitudinal direction exposed due to absence of a sheath at a part of the electric wire in the longitudinal direction; and fixing a terminal including a wire barrel portion to the electric wire such that the wire barrel portion covers at least a of the bonded portion after forming the bonded portion, wherein the wire barrel portion is provided with a load release portion configured to reduce stress applied to the conductor, and wherein a relationship of $0<A\leq(d+2t)-Hc$ is satisfied when a diameter of the conductor at a portion covered with the sheath is d, a thickness of the terminal is t, a height of the wire barrel portion of the terminal is Hc, and a height of a step of the load release portion is A.

* * * * *